United States Patent [19]

Röck et al.

[11] 4,379,604

[45] Apr. 12, 1983

[54] DRAWER

[75] Inventors: Erich Röck; Josef Brunner, both of Höchst, Austria

[73] Assignee: Julius Blum Ges.m.b.H., Höchst, Austria

[21] Appl. No.: 210,397

[22] Filed: Nov. 25, 1980

[51] Int. Cl.[3] ..... A47B 88/00; B65D 6/00

[52] U.S. Cl. ..... 312/330 R; 312/111; 312/140; 312/263

[58] Field of Search ..... 312/330 R, 111, 140, 312/140.4, 257 SK, 263

[56] References Cited

U.S. PATENT DOCUMENTS

| | | | |
|---|---|---|---|
| 1,936,733 | 11/1933 | Richardson | 312/330 R |
| 2,801,895 | 8/1957 | Gass | 312/257 SK |
| 3,131,829 | 5/1964 | Masser | 312/111 |
| 3,282,635 | 11/1966 | Himelreich | 312/330 R |
| 3,846,003 | 11/1974 | Rockwell | 312/330 R |
| 3,872,976 | 3/1975 | Moore et al. | 312/140.4 |
| 4,012,090 | 3/1977 | Pfeifer et al. | 312/330 R |
| 4,099,815 | 7/1978 | Cox et al. | 312/111 |
| 4,120,551 | 10/1978 | Godtschalck | 312/330 R |
| 4,298,234 | 11/1981 | Litchfield et al. | 312/330 R |

FOREIGN PATENT DOCUMENTS

| | | | |
|---|---|---|---|
| 1505538 | 12/1967 | France | 312/263 |

*Primary Examiner*—Victor N. Sakran

*Attorney, Agent, or Firm*—Wenderoth, Lind & Ponack

[57] ABSTRACT

A drawer for a piece of furniture includes the side walls and a back wall of which are members formed of plastic material. The side members and the back member are, when joined together, moved relatively in vertical direction. The back member has connecting elements in the form of T-shaped rails which slide into corresponding vertical slots in the two side members.

5 Claims, 8 Drawing Figures

DRAWER

BACKGROUND AND FIELD OF THE INVENTION

The present invention relates to a drawer an article of furniture, and having two side members and a back member made of plastics material. The side members each preferably have a longitudinal groove which can act as a guide channel for roller means. The side members and the back member have connecting elements for joining them together.

SUMMARY OF THE INVENTION

In particular, the present invention relates to a drawer formed of different members. The side members and the back member are made of plastics material which is normally injection moulded. The drawer front can be of any suitable material which has the optical features that are desired. A drawer bottom is pushed into grooves in both side members and the rear member. The drawer bottom can be made of hard wood.

The object of the present invention is to provide a drawer in which the side members and the back member are very rigidly connected to each other, especially resisting lateral forces tending to force the side members apart, whereby the drawer members still may be easily dismantled, if necessary.

According to the present invention there is provided a drawer for an article of furniture, with two side members and a back member made of plastics material, the side members and the back member having connecting elements for joining them together, the back member and the side members being relatively movable in vertical directions when connected with each other.

The back member and the side members are relatively in a vertical direction, in respect to the drawer bottom, in order to be connected with each other.

One embodiment of the invention provides two connecting elements, each being a T-shaped rail, preferably formed on the lateral sides of the back member. The T-shaped rails are slidable into vertical slots in the side members.

A further embodiment of the invention provides that the T-shaped rails are shorter than the height of the member on which they are located.

It is advantageous that each member having a slot into which the T-shaped rail is slidable has a hollow box section and that the slot is in an inner side wall adjacent to a T-shaped opening in the top web of the hollow side wall.

To facilitate handling of the drawer members, especially during assembling and before the bottom plate is fitted, a peg or the like is advantageously provided on one bar of the T-profile rail to act as a catch when the rail is pushed into the slot of the other member.

BRIEF DESCRIPTION OF THE DRAWINGS

The present invention will now be described by way of example only with reference to the accompanying drawings, in which.

DESCRIPTION OF THE PREFERRED EMBODIMENTS

Figure 1:
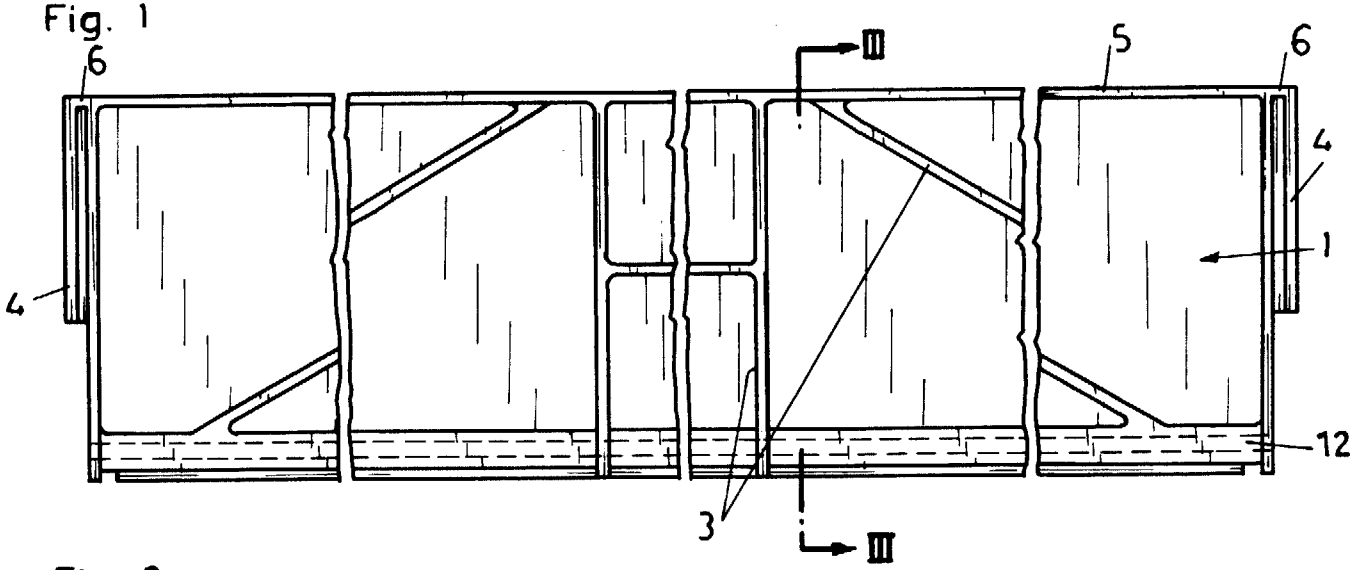
FIG. 1 is an elevation view of a back member of a drawer.
Figure 2:
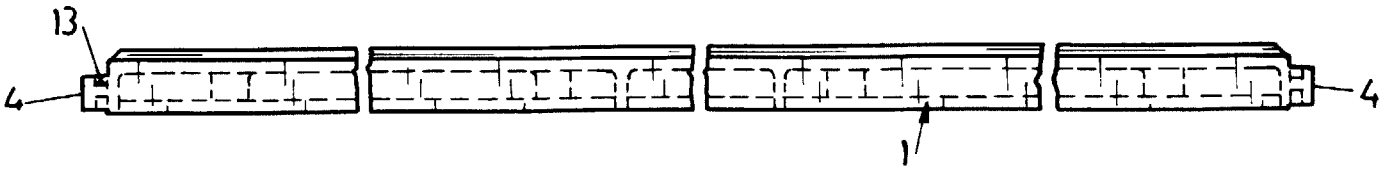
FIG. 2 is a plan view of the back member of FIG. 1.

Referring to the drawings, there is shown a back member 1 and two side members 2 of the drawer. Both members are made of plastics material, such as hard PVC or the like.

Figure 3:
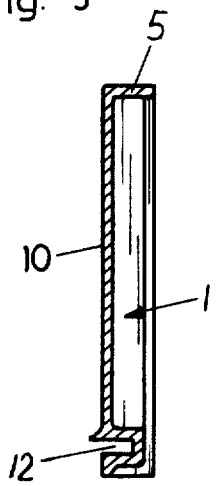
FIG. 3 is a section taken along the line III—III of FIG. 1.
Figure 4:
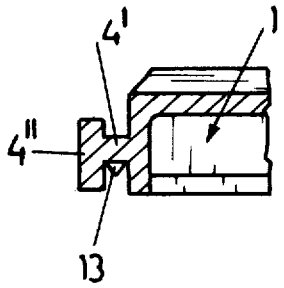
FIG. 4 is a horizontal section through a side edge of the back member of FIG. 1.
Figure 7:
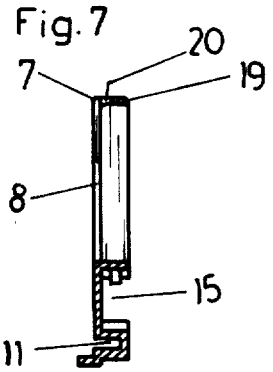
FIG. 7 is a section taken along line VII—VII of FIG. 5.
Figure 5:
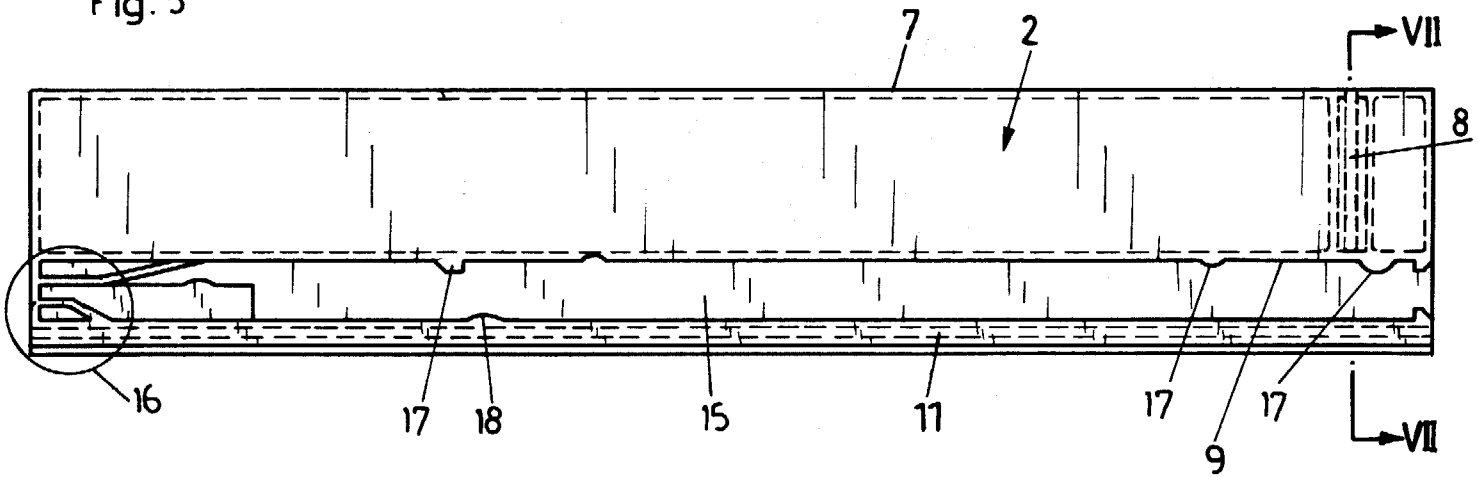
FIG. 5 is an elevation elevation of a side member of the drawer.
Figure 6:
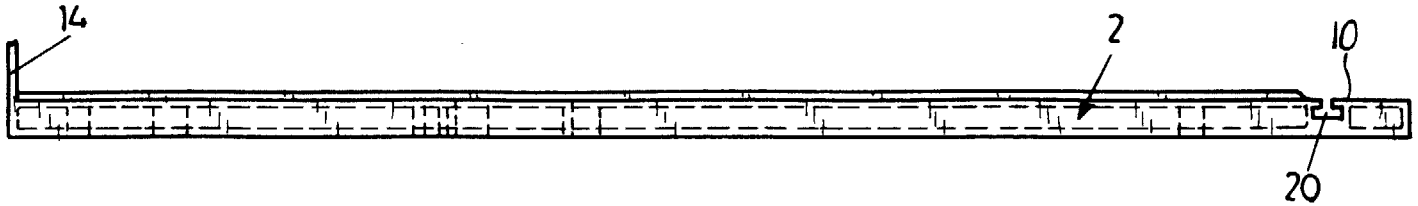
FIG. 6 is a plan view of the side member of FIG. 5.
Figure 8:
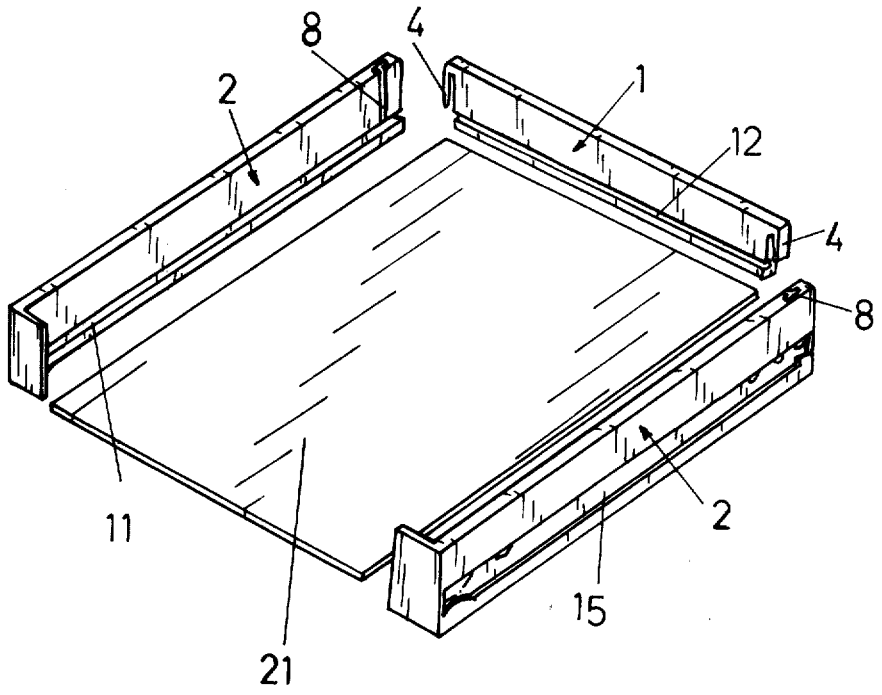
FIG. 8 is an exploded view of the drawer member.

Both the back member 1 and the side members 2 have a box-like section with one side open (see FIG. 3).

The back member 1 is provided with reinforcement bars 3. At each of its lateral ends the back member 1 has a T-shaped rail 4 which extends from the upper edge 5 of the back member 1 downwards over a distance slightly more than half of the height of the back member 1.

At their ends adjacent to the upper edge 5 the rails 4 have a bar 6 which rests on the upper edge 7 of the respective side member 2, when the drawer is assembled. Each side member has near its rear end a vertical slot 8, its length corresponding to the length of the rail 4. The slot 8 is open to the upper edge 7 of the side member 2, and at the bottom it is terminated by a web 9.

The slot 8 is just slightly wider than the web 4' of the rail 4. When the rails 4 of back member 1 are 4 pushed into the slots 8 of the side members 2, the web 4'' of each rail 4 is behind the plane inner wall 10 of the respective side member so that the back member 1 is hooked into the side members 2.

The top flange 19 of the side member 2 has a T-shaped cut-out 20 through which the rails 4 are pushed into the slots 8.

When the back member 1 and the side members 2 have been connected, a bottom plate 21 is pushed into grooves 11 of the side members 2 and a groove 12 in the back member 1.

To improve the hold of the side members 2 and the back member 1 before the plate 21 is inserted, the rails 4 are provided with one or more pegs or projections 13 which are pressed into the side walls of the slots 8.

At their front ends the side members 2 have connecting elements 14 to which a front panel can be fixed. On the outer side, the side members 2 each have a longitudinal groove 15, which serves as a guide channel for roller means which are held on a support rail fixed to the side wall of a piece of furniture.

At the front end of the groove 15 abutment means 16 for a horizontal flange of the support rail are provided.

In the groove 15, especially on its top wall, there are stops 17 and elevations 18 which serve as control elements for the movement of the roller carrier.

What is claimed is:

1. A drawer for an article of furniture, said drawer comprising:

two side members and a back member;

each said member being formed of a plastic material;

opposite ends of said back member including integral first connecting elements connectable to respective second connecting elements of said side members by relative vertical movement between said back member and said side members;

each of one of said first and second connecting means comprising a vertically extending T-shaped rail;

each of the other of said first and second connecting means comprising a vertically extending slot of a dimension to vertically slidably receive by complementary abutting surface contact a respective said T-shaped rail;

the said member having therein each said slot having a hollow box-like configuration including an inner side wall and an upper web, said slot being formed in said inner side wall and opening into a T-shaped opening in said upper web;

said back member and said side members having formed in inner sides thereof respective longitudinal horizontal grooves extending in a single horizontal plane when said back member and said side members are connected; and a bottom drawer member slidably fitting into said grooves.

2. A drawer as claimed in claim 1, wherein the vertical height of each said rail and the respective said slot is more than half, and less than the entire, height of the respective said members.

3. A drawer as claimed in claim 1, wherein said T-shaped rails are at opposite lateral ends of said back member, and said slots are in said side members.

4. A drawer as claimed in claim 1 or claim 3, wherein each said side member has formed exteriorly therein a horizontal longitudinal groove forming a guide channel for a roller member of the drawer.

5. A drawer as claimed in claim 1 or claim 3, wherein each said rail includes a web having extending therefrom a projection pressing into a wall edge defining the respective said slot.

* * * * *